US006392505B1

(12) United States Patent
Ito

(10) Patent No.: US 6,392,505 B1
(45) Date of Patent: May 21, 2002

(54) DIELECTRIC DEVICE

(75) Inventor: Kenji Ito, Mie (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/404,191

(22) Filed: Sep. 23, 1999

(30) Foreign Application Priority Data

Sep. 24, 1998 (JP) ..... 10-269730
Aug. 9, 1999 (JP) ..... 11-255430

(51) Int. Cl.[7] ..... H01P 1/205; H01P 1/213
(52) U.S. Cl. ..... 333/134; 333/202; 333/206
(58) Field of Search ..... 333/206, 202, 333/202 DB, 134

(56) References Cited

U.S. PATENT DOCUMENTS 5,214,398 A * 5/1993 Hayashi ..... 333/206
5,374,910 A * 12/1994 Yamagata ..... 333/206
6,057,746 A * 5/2000 Ito ..... 333/206 X

FOREIGN PATENT DOCUMENTS

| | | | |
|---|---|---|---|
| JP | 63-311801 | 12/1983 | ..... H01P/1/213 |
| JP | 61-237501 | 10/1986 | ..... H01P/7/04 |
| JP | 62-77702 | 4/1987 | ..... H01P/1/205 |
| JP | 6-125206 | 5/1994 | ..... H01P/1/205 |
| JP | 7-176913 | 7/1995 | ..... H01P/1/205 |
| JP | 7-283612 | 10/1995 | ..... H01P/1/205 |
| JP | 8-97606 | 4/1996 | |

* cited by examiner

*Primary Examiner*—Benny T Lee
(74) *Attorney, Agent, or Firm*—Sughrue Mion, PLLC

(57) ABSTRACT

A dielectric device is provided which comprises a dielectric resonator element having a plurality of resonators arranged in parallel with each other, a multilayer circuit element having conductive patterns constituting a coupling circuit, the conductive patterns being laminated vertically while alternating with dielectric layers, the circuit element being rectangular and having a pair of opposite vertical side surfaces, the coupling circuit having first connecting ends disposed at the first vertical side surface and second connecting ends disposed at the second vertical side surface, a plurality of vertical conduction grooves disposed at the first vertical side surface, the conduction groove having open upper ends and electrically connected to the first connecting ends of the coupling circuit, a plurality of metallic terminal members fitted in respective through holes of the resonators and thereby electrically connected to inner conductors of the resonators while being fitted in the conduction grooves and thereby electrically connected to the first connecting ends of the coupling circuit, and a printed board mounting thereon the resonator element and the circuit element and having external connecting terminals electrically connected to the second connecting ends of the coupling circuit.

12 Claims, 7 Drawing Sheets

DIELECTRIC DEVICE

BACKGROUND OF THE INVENTION

1. Field of the Invention

The present invention relates to a dielectric device such as a dielectric duplexer consisting of a plurality of resonators arranged in parallel with each other, for use in mobile communication devices such as a mobile telephone, portable telephone and the like.

2. Description of the Related Art

A dielectric duplexer includes a plurality of resonators which are arranged in parallel with each other. An outer or grounding conductor covers the outer peripheral surface of the resonators except for an open end surface where through holes of the resonators open to the outside. The resonators are placed on a substrate which is provided with a coupling circuit for connection thereof. Such a dielectric duplexer is disclosed in Japanese Patent Provisional Publication No. 63-311801.

The dielectric duplexer has circuit elements such as a coupling capacitor for LC coupling between the respective resonators, which are mounted on a substrate, or conductors formed on the substrate for constituting a predetermined circuit. Such circuit elements or conductors are covered by a metal case which serves as a shielding case. The substrate is further provided with input/output electrodes for connection with external conductors. The duplexer is thus formed into a unit. Since the duplexer is formed into a unit in the above manner, its handling can be easier. Further, in such a structure, the coupling capacitor and the like are mounted on the substrate independently, so the circuit constant and the like can be set suitably and therefore good design freedom can be attained.

In the prior art structure, metallic terminal members which are fitted in the through holes of the respective resonators, are connected by way of lead wires to predetermined conductors formed on the substrate. Connection of the lead wires to the conductors is difficult and additional mounting of coupling capacitors on the substrate is necessitated, thus causing a problem in that the man-hours of labor required for assembly is increased and the circuit becomes imperfect, unsound or imprecise in design and fabrication, i.e., the design of the circuit becomes complicated. To solve such a problem, it has been proposed such a dielectric duplexer consisting of a dielectric resonator element and a multilayer circuit element which are connected to each other, as shown in FIGS. 9 and 10.

The dielectric duplexer shown in FIG. 9 consists of a dielectric resonator element a made up of a plurality of resonators b arranged in parallel, with each other and a multilayer circuit element c. Each resonator b has a connecting terminal d protruding from an open end thereof and electrically connected to an inner conductor. The connecting terminals d of the resonators b are disposed above the multilayer circuit element c and soldered to connection electrodes e formed on the upper surface of the multilayer circuit element c.

In such a structure, the multilayer circuit element c is required to be nearly half the thickness of the resonator element a so that the lower or bottom surfaces of the multilayer circuit element c and the resonator element a are flush with each other when the terminals d are connected to the electrodes e to allow the resonator element a and the circuit element c to be formed into an integral unit. This causes restrictions on the thickness of the multilayer circuit element c. As a result, there arises a possibility that by such a circuit element c an LC coupling circuit having an optimum capacitance and inductance cannot be attained. In case the bottom surfaces of the dielectric resonator element a and the circuit element b are not flush with each other, an unsound, unstable or unsecured condition of the resonator element a and/or the circuit element c may be realized at the time of their mounting onto a mounting circuit board, i.e., the resonator element a and/or the circuit element c cannot fit well on the mounting circuit board and therefore cannot be mounted thereon in a stable state.

The dielectric duplexer shown in FIG. 10 consists of a dielectric resonator element m made up of a plurality of resonators n arranged in parallel with each other and a multilayer circuit element p. The open end of the resonator element m is connected directly to the joining surface of the circuit element p so that the inner conductors o of the respective resonators n are connected to a conductor pattern (not shown) formed on the joining surface of the circuit element p.

In such a structure, the resonator element m and the circuit element p are adapted to be formed into a rectangular shape when joined together. To this end, the joining surface of the circuit element p and the open end of the resonator element m are required to have the same shape. Due to this, the joining surface of the circuit element p cannot be made larger as desired, thus causing a problem that, similarly to the structure of FIG. 9, the dielectric duplexer cannot attain an LC coupling circuit having an optimum capacitance and inductance. Further, in case the bottom surfaces of the resonator element m and the circuit element p are not flush with each other, an unsound, unstable or unsecured condition of the resonator element m and/or the circuit element p can result when the resonator element m and the circuit element p are mounted onto a mounting circuit board, i.e., the resonator element m and/or the circuit element p cannot fit well on the mounting circuit board and therefore cannot be mounted thereon in a stable state.

SUMMARY OF THE INVENTION

It is therefore an object of the present invention to provide a dielectric device which is free from the problems inherent in the prior art device.

It is another object of the present invention to provide a dielectric device of the foregoing character which is easy in assembling and simple in structure.

To achieve the foregoing objectives, there is provided according to an aspect of the present invention a dielectric device which comprises a dielectric resonator element having a plurality of coaxial resonators arranged in parallel with each other, the resonators having through holes provided with inner conductors, respectively, a multilayer circuit element having conductive patterns constituting a coupling circuit, the conductive patterns being laminated vertically while alternating with dielectric layers, the circuit element being rectangular and having a pair of first and second opposite vertical side surfaces extending along the longitudinal direction thereof, the coupling circuit having first connecting ends disposed at the first vertical side surface and second connecting ends disposed at the second vertical side surface, and a plurality of metallic terminal members electrically connecting between the inner conductors of the resonators and the first connecting ends of the coupling circuit.

According to another aspect of the present invention, there is provided a dielectric device which comprises a dielectric resonator element having a plurality of resonators arranged in parallel with each other, the resonators having through holes provided with inner conductors, respectively, a multilayer circuit element having conductive patterns constituting a coupling circuit, the conductive patterns being laminated vertically while alternating with dielectric layers, the circuit element being rectangular and having a pair of first and second opposite vertical side surfaces extending along the longitudinal direction thereof, the coupling circuit having first connecting ends disposed at the first vertical side surface and second connecting ends disposed at the second vertical side surface, a plurality of metallic terminal members electrically connecting between the inner conductors of the resonator element ad the first connecting ends of the coupling circuit, and a printed board mounting thereon the resonator element and the circuit element and having external connecting terminals electrically connected to the second connecting ends of the circuit element.

With the above structures, the resonator element and circuit element are electrically connected to each other by means of the metallic terminal members, so lead wires, wire bonding or the like is not necessitated. Thus, the dielectric device can be simple in structure while being capable of obtaining a neat or orderly appearance.

With the structure in which the resonator element and the circuit element are supported on the printed board, the dielectric device can have a single, planar bottom surface which is formed by the printed board, thus enabling the dielectric device to be mounted on a mounting circuit board stably without causing an unsound, unstable or unsecured condition thereof.

With the structure in which the circuit element whose conductive patterns are laminated vertically while alternating with dielectric layers, is electrically connected with the resonator element at one vertical side surface, so a variation of the horizontal area or extension of the circuit element does not cause any variation of the thickness of the circuit element and any obstacle in assembling. For this reason, the invented dielectric device does not have such restrictions on the shape that are otherwise caused by the prior art structures shown in FIGS. 9 and 10 thus making it possible to attain good design freedom and an LC coupling circuit having improved capacitance and inductance.

DETAILED DESCRIPTION OF THE PREFERRED EMBODIMENTS

Figure 1:
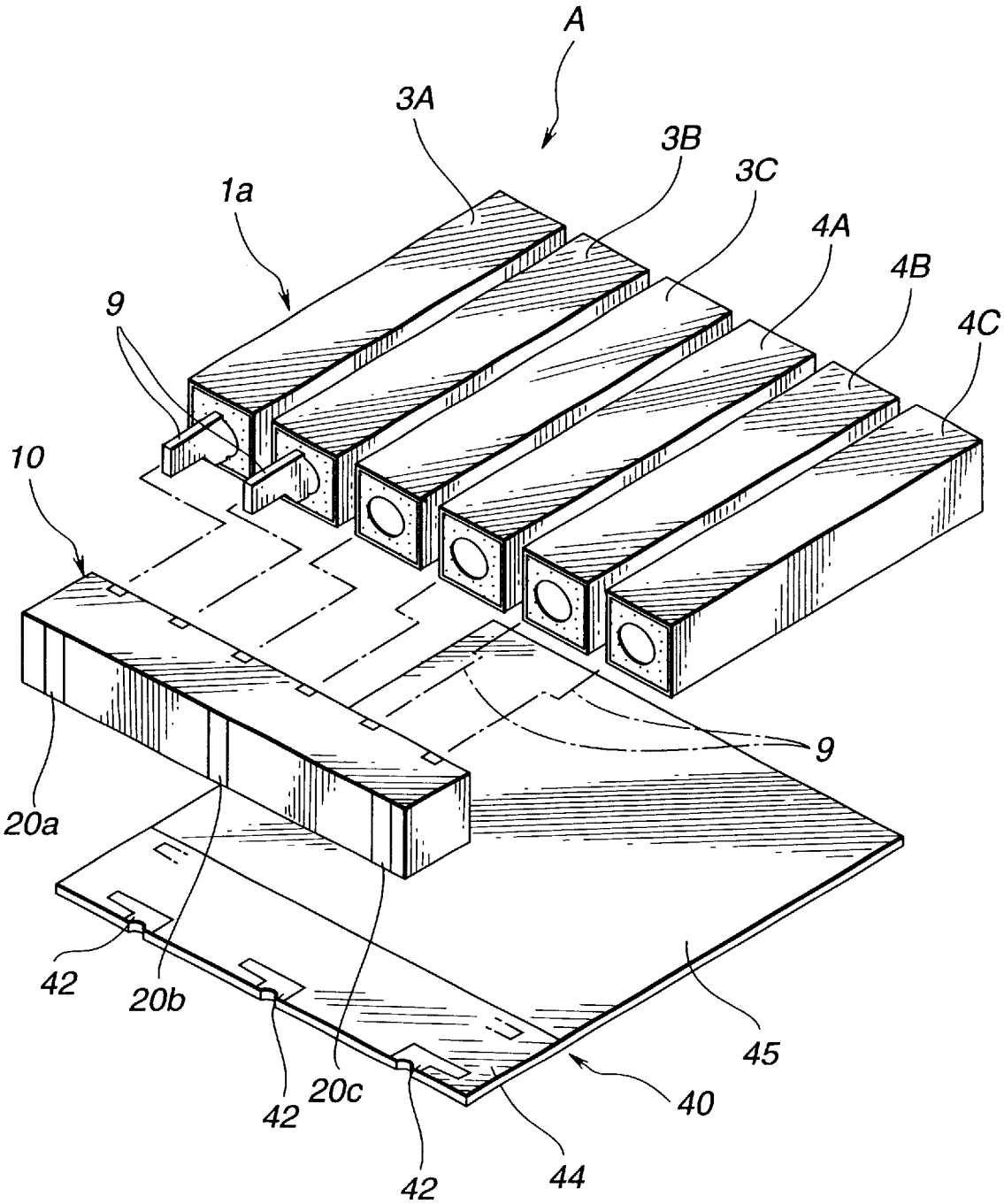
FIG. 1 is a perspective view of a dielectric device according a first embodiment of the present invention.
Figure 6:
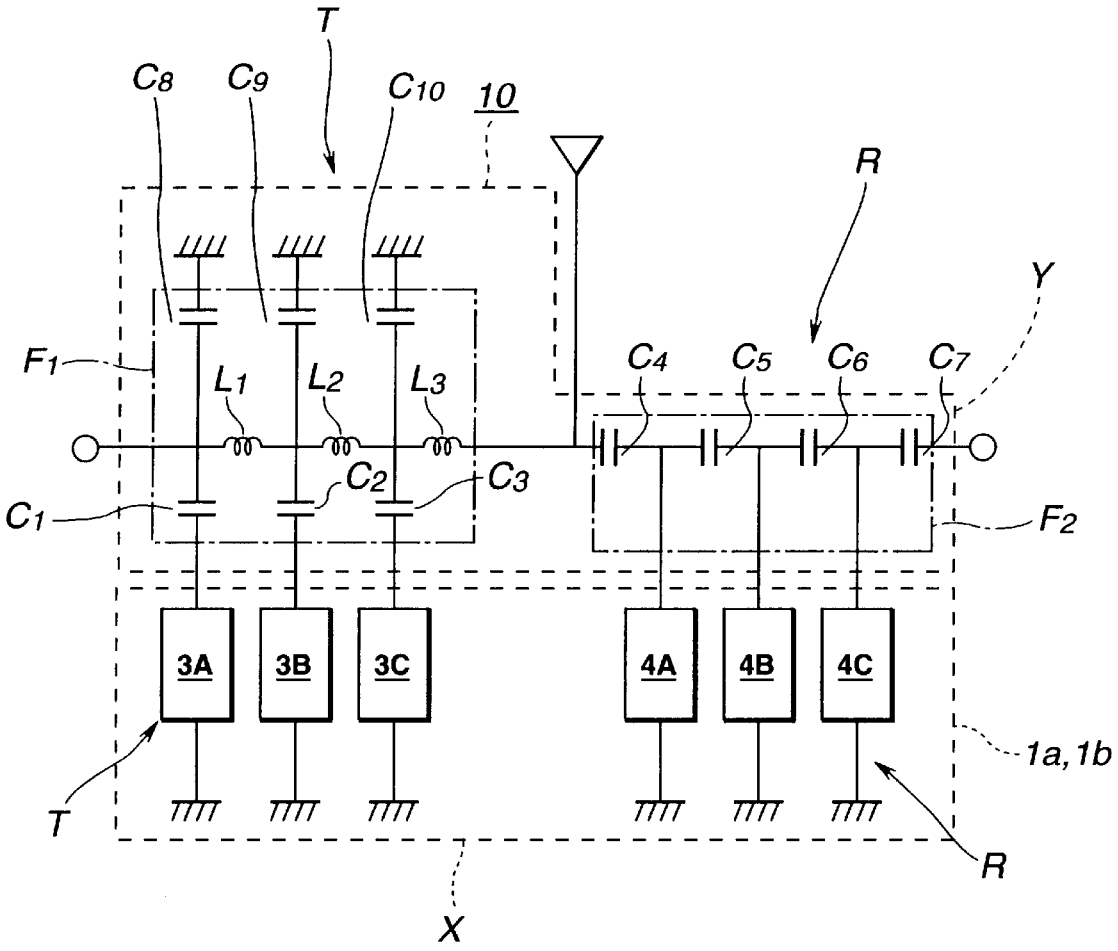
FIG. 6 is a circuit diagram of an equivalent circuit of the dielectric device of FIG. 1.

Referring first to FIG. 1, a dielectric device according to a first embodiment of the present invention is generally indicated by A. The dielectric device A is adapted to serve as a dielectric duplexer having such a transmitting and receiving circuit as shown in FIG. 6.

The dielectric device A consists of a printed board 40, a dielectric resonator element 1*a* and a multilayer circuit element 10 (refer to FIG. 1, FIG. 2, FIG. 3, FIG. 6 and FIG. 7). The dielectric resonator element la and the multilayer circuit element 10 are mounted on the printed board 40. The printed board 40 is in the form of a planar plate so sized as to cover the bottom surfaces of the dielectric resonator element 1*a* and the multilayer circuit element 10. By this, the dielectric device A is formed into, as a whole, a thin, rectangular shape, for example, 4 mm thick, 10 mm long and 23 mm broad.

The dielectric resonator element 1*a* is made up of a plurality of coaxial resonators 3A, 3B, 3C (refer to FIG. 1, FIG. 2, FIG. 3, FIG. 6 and FIG. 7) and 4A, 4B, 4C (refer to FIG. 1, FIG. 2, FIG. 3, FIG. 6 and FIG. 7) which are arranged in parallel with each other. The resonators 3A, 3B, 3C and 4A, 4B, 4C are divided into two groups, i.e., a first group of resonators 3A, 3B, 3C for constituting a transmitting section T and a second group of resonators 4A, 4B, 4C for constituting a receiving section R (refer to FIG. 6). The coaxial resonators 3A, 3B, 3C and 4A, 4B, 4C are attached to the printed board 40 and held thereon, individually. In this connection, the coaxial resonators may be first joined together in a way as to be parallel with each other and attached to the printed board 40 all together.

Figure 2:
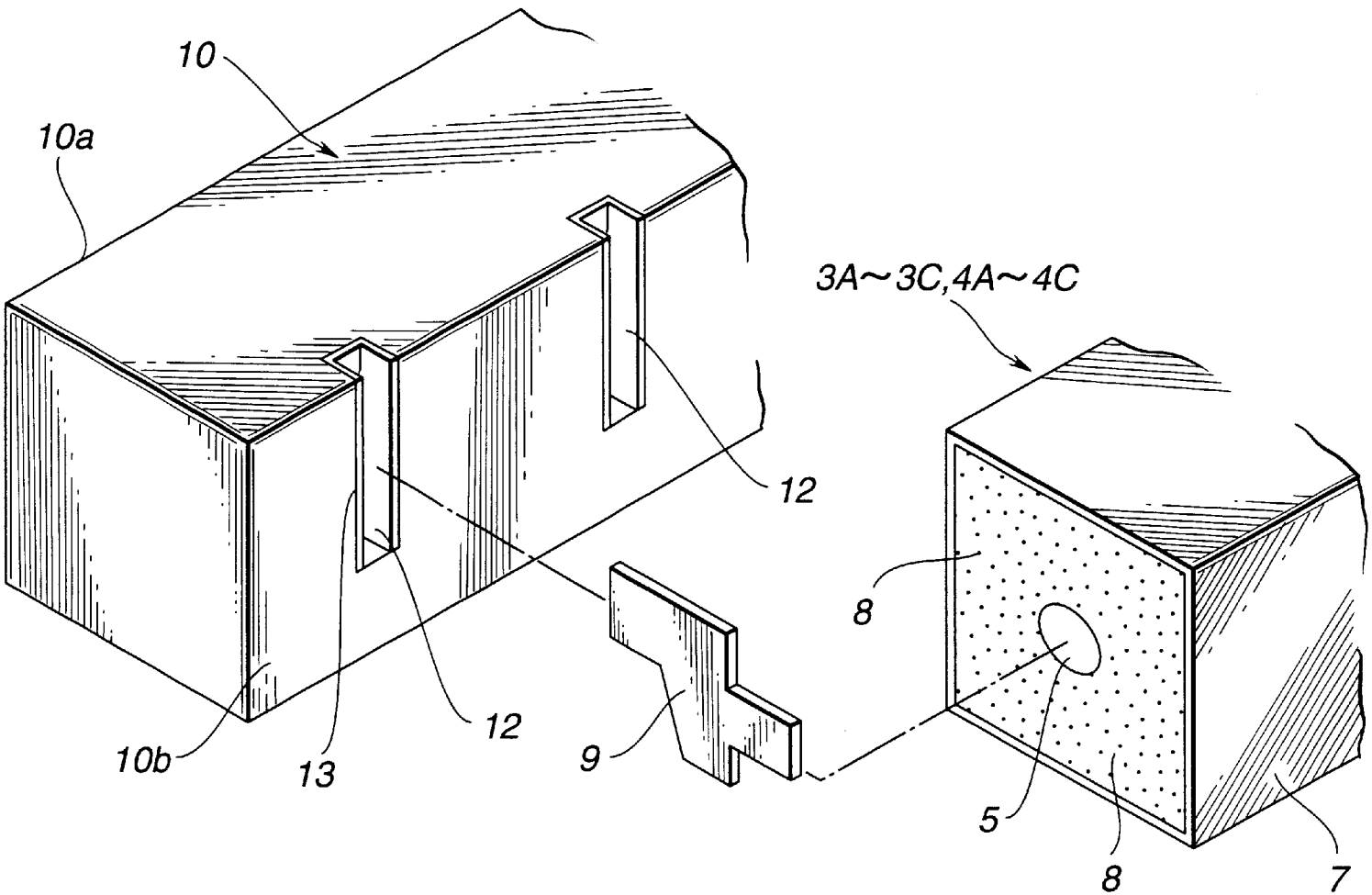
FIG. 2 is an enlarged perspective view of an important portion of the dielectric device of FIG. 1, for illustrating a joining structure between a dielectric resonator element and a multilayer circuit element.
Figure 3:
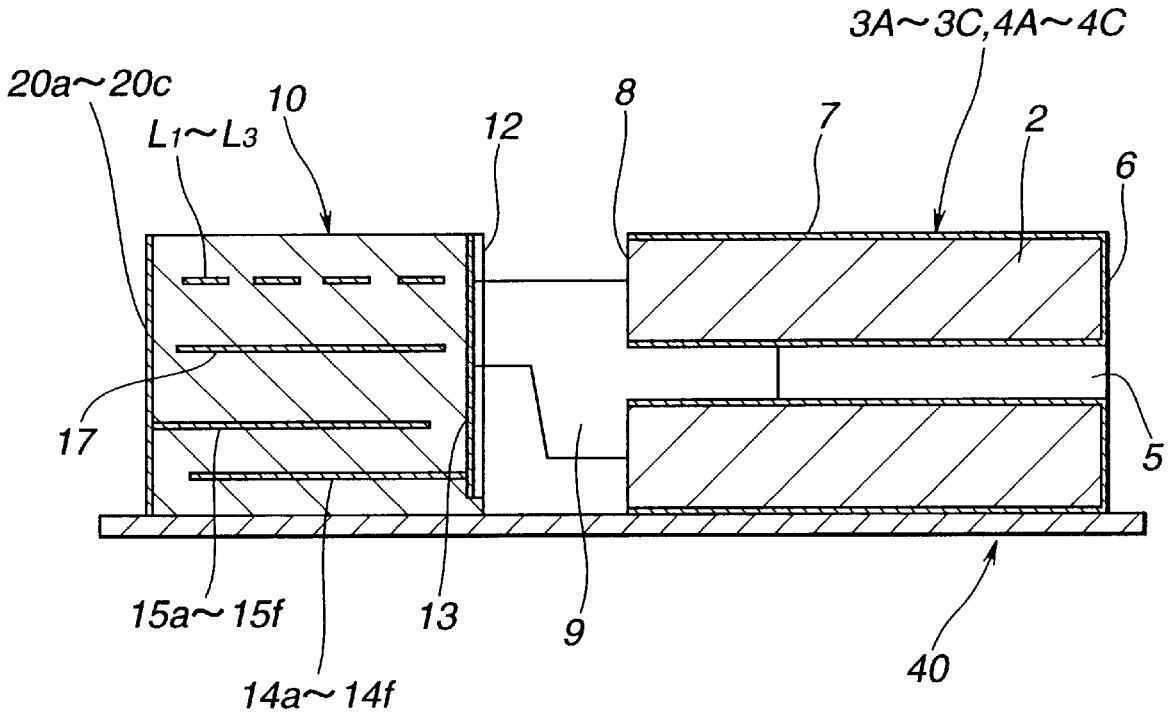
FIG. 3 is a longitudinal sectional view of the dielectric device of FIG. 1.

Referring to FIGS. 2 and 3, each of the resonators 3A, 3B, 3C and 4A, 4B, 4C consists of a dielectric ceramic block 2 which is formed by sintering a dielectric ceramic material such as a titanium oxide containing type, barium oxide containing type or the like. The dielectric ceramic block 2 is formed with a through hole 5. The through hole 5 has on the inner circumferential surface thereof an inner conductor 6 (refer to FIG. 3 and FIG. 8) which is formed, for example, by applying a conductive paste onto the inner circumferential surface and sintering the applied paste. The dielectric ceramic block 2 is covered by an outer conductor 7 except for an open end surface 8 which faces the circuit element 10 and through which an end of the through hole 5 opens to the outside. Each of the resonators 3A, 3B, 3C and 4A, 4B, 4C is of such a length nearly equal to ¼ of the wavelength $\lambda$ of the resonant frequency. The resonators 3A, 3B, 3C and 4A, 4B, 4C constitute such a resonance circuit X shown in FIG. 6.

In each through hole 5 is fitted a metallic terminal member 9 having such a shape shown in FIGS. 1, 2 and 3 , i.e., having an end fitted in the through hole 5 and another end protruding from the open end of each resonator.

Figure 4:
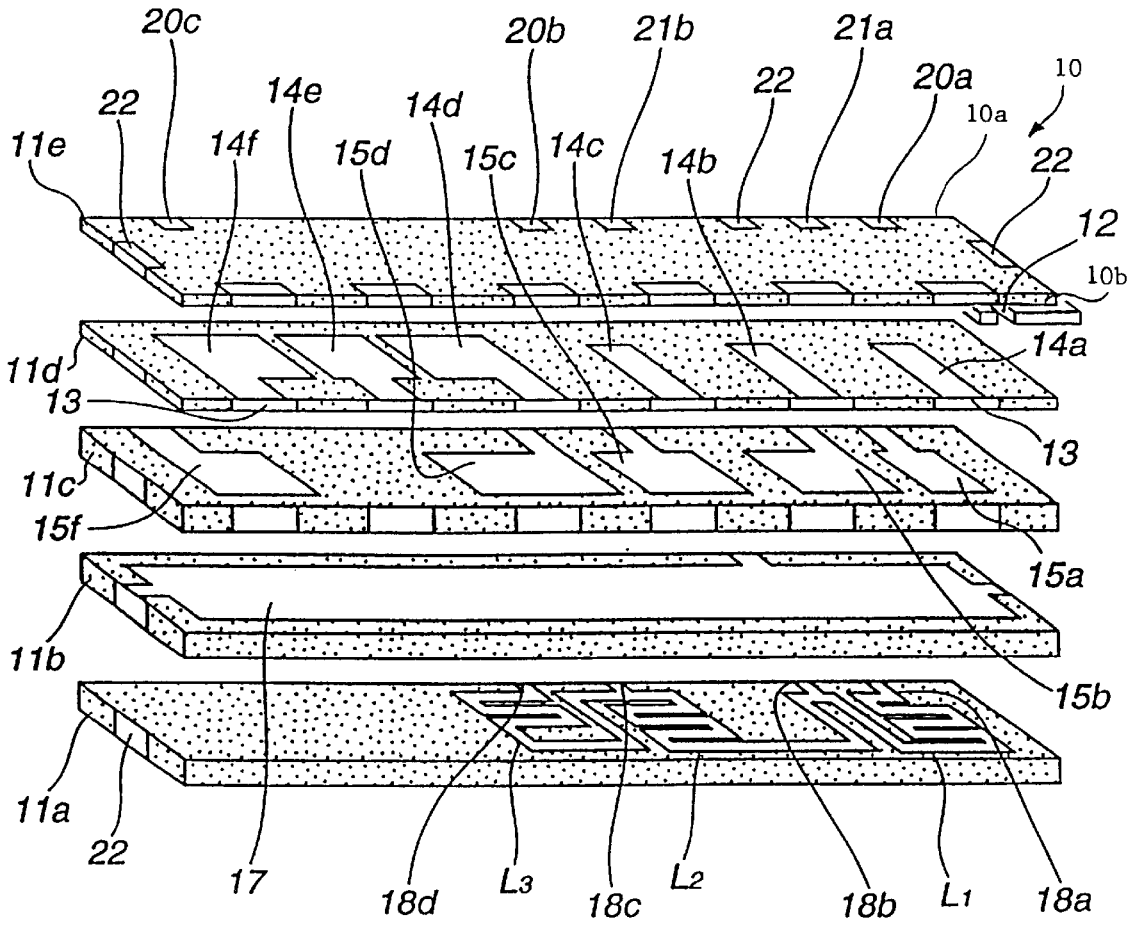
FIG. 4 is an exploded view of the multilayer circuit element of the dielectric device of FIG. 1.

With additional reference to FIG. 4, the multilayer circuit element 10 consists of a plurality of rectangular dielectric layers 11*a*, 11*b*, 11*c*, 11*d*, and 11*e* made of glass ceramic, a composite material of glass and dielectric ceramic or low-melting point oxide. The dielectric layers 11*a*, 11*b*, 11*c*, 11*d*, 11*e* are laminated together and sintered. Of the four vertical side surfaces of the multilayer circuit element 10, vertical side surface 10*b* (refer to FIG. 2), which is elongated longitudinally of the circuit element 10, has such a rectangular shape as to cover all the open end surface of the dielectric resonator element 1*a*. The circuit element 10 has at the vertical side surface 10*b* and at corresponding positions to the through holes 5 of the resonators 3A, 3B, 3C and 4A, 4B, 4C a plurality of vertical conduction grooves 12 (refer to FIG. 2 and FIG. 3) which are open at least at upper ends thereof. As shown in FIG. 3, each conduction groove 12 has on an inner surface a connecting conductor 13 (refer to FIG. 2, FIG. 3 and FIG. 4) which is formed by applying a conductive paste or the like onto the inner surface. By this, the conduction grooves 12 have a conductivity and are electrically connected to connecting ends of a coupling circuit Y (refer to FIG. 6) which will be described hereinafter. Further, the conduction grooves 12 are in the form of a slit whose upper end is open to the outside so that the metallic terminal members 9 can be fitted in the conduction grooves 12 by the open upper ends. In the meantime, in case the metallic terminal members 9 are fitted in the conduction grooves 12 by the open ends directed sideways, the upper open ends are not needed so the conduction grooves 12 can be of a simple rectangular hole.

The multilayer circuit element 10 consisting of the dielectric layers 11*a*, 11*b*, 11*c*, 11*d*, 11*e*, constitutes the coupling circuit Y including a low-pass filter circuit section F1 and a band-pass filter circuit section F2 as shown in FIG. 6. The multilayer circuit element 10 is in the form of a single chip or piece after sintering of dielectric layers 11*a*, 11*b*, 11*c*, 11*d*, 11*e* (refer to FIG. 4) together with conductive patterns, and has a rectangular shape of a uniform cross section. The multilayer circuit element 10 and the resonators 3A, 3B, 3C and 4A, 4B, 4C, when connected by the metallic terminal members 9, are formed into a rectangular shape as a whole. By mounting the circuit element 10 and the resonator element 1*a* (refer to FIG. 1 and FIG. 6) under the condition of being connected to each other on the printed board 40, a dielectric duplexer of a neat or orderly shape can be obtained with ease. Printed circuit board 40' shown in FIG. 8 is a variant of the printed circuit board 40 shown in FIGS. 5 and 7.

Each of the dielectric layers 11*a*, 11*b*, 11*c*, 11*d*, 11*e* has a predetermined conductive pattern printed on the upper surface and the periphery of the layer. The dielectric layers 11*a*, 11*b*, 11*c*, 11*d*, 11*e* will be described more in detail with reference to FIG. 4. FIG. 4 is an exploded view of the dielectric layers 11*a*, 11*b*, 11*c*, 11*d*, 11*e* when viewed from below.

On the upper surface of the dielectric layer 11*c* are formed capacitor electrodes 15*a*, 15*b*, 15*c*, 15*d* and 15*f* (refer to FIG. 3 and FIG. 4; 15*e* is a missing number or skipped number) which are respectively opposed to capacitor electrodes 14*a*, 14*b*, 14*c*, 14*d* and 14*f* (refer to FIG. 3 and FIG. 4) by way of the dielectric layer 11*d*.

As depicted in FIG. 6, the capacitor electrodes 14*a* and 15*a* is formed a capacitor C1. By the capacitor electrodes 14*b* and 15*b* is formed a capacitor C2. By the capacitor electrodes 14*c* and 15*c* is formed a capacitor C3. By the capacitor electrodes 14*d* and 15*d* is formed a capacitor C4. By the capacitor electrodes 14*f* and 15*f* is formed a capacitor C7. Further, a capacitor electrode 14*e* is formed on the upper surface of the dielectric layer 11*d*. The capacitor electrode 14*e* is located adjacent to the capacitor electrode 14*d* and away therefrom in the direction of extension of the upper surface of the dielectric layer 1*d*. By the capacitor electrodes 14*d* and 14*e* is formed a capacitor C5. Similarly, by fine capacitor electrodes 14*e* and 14*f* is formed a capacitor C6. In this connection, the capacitor electrodes 14*a*, 14*b*, 14*c*, 14*d* and 14*f* are electrically connected to the conduction grooves 12, respectively. For this reason, the capacitor electrodes 14*a*, 14*b*, 14*c*, 14*d* and 14*f* are extended to the front edge of the dielectric layer 11*d* so as to serve as the connecting ends of the coupling circuit Y for connection with the resonator element 1*a*.

Returning to FIG. 4, on the upper surface of the dielectric layer 11*b* is formed a shield electrode layer 17 which cooperates with the capacitor electrodes 15*a*, 15*b* and 15*c* to constitute capacitor C8, capacitor C9, capacitor C10, respectively as depicted in FIG. 6. The shield electrode layer 17 is connected to a grounding conductor by way of grounding pads 22 (depicted in FIG. 4) formed at the front end and at opposite lateral ends of the multilayer circuit element 10.

Further, in FIG. 4, on the upper surface of the dielectric layer 11*a* is formed an electrode in a zigzag fashion, which zigzag electrode have opposite connecting ends 18*a* and 18*d* and intermediate connecting portions 18*b* and 18*c* such that three inductors L1, L2 and L3 (refer to FIG. 3, FIG. 4 and FIG. 6) are formed.

The connecting end 18*a* is connected to transmitting pad 20*a* (refer to FIG. 1, FIG. 3, and FIG. 4 for 20*a*–20*c*) formed on the side surface 10*b* of the multilayer circuit element 10, which side surface 10*b* is one of the side surfaces extending longitudinally of the circuit element 10, together with the capacitor electrode 15*a*. Further, the connecting ends 18*b* and 18*c* are connected to relay conductors 21*a* and 21*b* formed on the side surface 10*b* of the multilayer circuit element 10 together with the capacitor electrodes 15*b* and 15*c*. Further, the connecting end 18*d* is connected to an antenna pad 20*b* formed on the side surface 10*b* of the circuit element 10.

In FIG. 4, the capacitor electrode 15*d* is also connected to the antenna pad 20*b*, and the capacitor electrode 15*f* is connected to a receiving pad 20*c* formed on the side surface 10*b* of the multilayer circuit element 10 (refer to FIG. 2, for 10 and 10*b*).

The above described pads of FIG. 4, 20*a*, 20*b*, 20*c*, grounding pad 22 and relay conductors 21*a* and 21*b* are formed by metallization of the longitudinal side surface 10*b* using a conductive material. Such metallization is performed at the same time when the conductive patterns, alternating with the dielectric layers 11*a*, 11*b*, 11*c*, 11*d*, 11*e*, are laminated together and sintered to constitute the multilayer circuit element 10.

The multilayer circuit element 10 with the above described structure are adapted to connect the various capacitor electrodes and inductors by way of the pads 20*a*, 20*b*, 20*c* and the relay conductors 21*a* and 21*b* which are formed on the other vertical side surface 10*b* (of FIG. 2) opposite to the vertical side surface 10*a* (of FIG. 2) by metallization. Due to this, there is no necessity of forming through holes in the dielectric substrates. Accordingly, as compared with a multilayer circuit element using through holes, which requires a process of filling the through holes by printing or the like and therefore has a poor productivity, the multilayer circuit element of the structure described as above can improve the productivity.

The multilayer circuit element 10 is formed with the conduction grooves 12 after laminating but before sintering of the dielectric layers 11*a*, 11*b*, 11*c*, 11*d*, 11*e*. On the inner surface of the conduction grooves 12 is formed the connecting conductors 13 by applying thereto a conductive paste and sintering it. The connecting conductors 13 are electrically connected to the capacitor electrodes 14*a*, 14*b*, 14*c*, 14*d*, 14*e*, 14*f* (shown in FIG. 4), respectively. By this, the connecting ends of the coupling circuit Y, which are constituted by the connecting conductors 13, are exposed to the outside of the multilayer circuit element 10.

With the above described structure, the multilayer circuit element 10 is formed with the low-pass filter circuit section F1 consisting of the capacitors $C_1$, $C_2$, $C_3$, $C_8$, $C_9$, $C_{10}$ and inductors L1, L2, L3, and the band-pass filter circuit section F2 as depicted in FIG. 6, i.e., the coupling circuit Y also shown in FIG. 6 by laminating the conductive patterns for the above described various electrodes and the like, alternating with the dielectric layers 11*a,* 11*b,* 11*c,* 11*d,* 11*e,* and sintering them all at once.

On the printed board 40 of FIG. 3, the multilayer circuit element 10 and the resonator element 1*a* are held so as to allow the metallic terminal members 9 protruding from the coaxial resonators 3A, 3B, 3C, 4A, 4B, 4C to be fitted in the conduction grooves 12 by the open upper ends thereof and thereby electrically connected to the capacitor electrodes 14*a,* 14*b,* 14*c,* 14*d,* 14*e,* respectively. By this, the low-pass filter circuit section F1 is connected to the resonators 3A, 3B, 3C of the transmitting section T, and the band-pass filter circuit section F2 is connected to the resonators 4A, 4B, 4C of the receiving section R. The transmitting and receiving circuits (T and R) as shown in FIG. 6 is thus constituted by the coupling circuit Y and the resonance circuit X consisting of the resonators 3A, 3B, 3C of the transmitting section T and the resonators 4A, 4B, 4C of the receiving section R.

Then, mounting of the dielectric resonator element 1*a* and the multilayer circuit element 10 onto the printed board 40 will be described.

The multilayer circuit element 10 is mounted on the printed board 40 in such a manner that the pads 20*a,* 20*b,* 20*c* are disposed on the outer side of the circuit element 10 as shown in FIG. 1.

Figure 5:
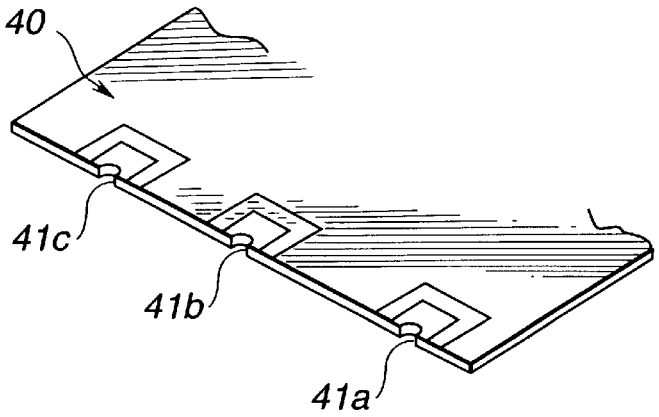
FIG. 5 is a perspective view of a portion of a printed board of the dielectric device of FIG. 1 and shows a bottom surface of the printed board.

As shown in FIG. 5, the printed board 40 has at the lower or bottom surface thereof a transmitting terminal 41*a,* an antenna terminal 41*b* and a receiving terminal 41*c* which serve as external connecting terminals capable of being connected to external conductors.

Returning to FIG. 1, the printed board 40 also has connecting terminals 42 at an upper surface section which serves as a mounting surface for mounting thereon the multilayer circuit element 10 and at corresponding positions to the pads 20*a,* 20*b,* 20*c*. By way of the respective connecting terminals 42, the transmitting pad 20*a,* the antenna pad 20*b* and the receiving pad 20*c* are electrically connected to the transmitting terminal 41*a,* the antenna terminal 41*b* and the receiving terminal 41*c,* respectively shown in FIG. 5. In the above manner, the multilayer circuit element 10 is attached to the printed board 40. Then, the dielectric resonators 3A, 3B, 3C and 4A, 4B, 4C of the resonator element 1*a* are mounted on the printed board 40 in such a manner that the metallic terminal members 9 are fitted in the respective conduction grooves 12, for example, by the open upper ends thereof, and attached to the printed board 40. By this, the coaxial resonators 3A, 3B, 3C and 4A, 4B, 4C are arranged in parallel with each other. In this connection, a shield electrode layer 45 is formed on the upper surface of the printed board 40 except for the multilayer circuit element mounting surface 44.

The transmitting and receiving circuit constituted by the dielectric resonator element 1*a* and the multilayer circuit element 10 is thus formed on the printed board 40 and is connectable to the external conductors through the transmitting terminal 41*a,* the antenna terminal 41*b* and the receiving terminal 41*c*.

In this manner, the resonator element 1*a,* circuit element 10 and printed board 40 constituting the dielectric device (dielectric duplexer) are formed into a single unit, i.e., unitized and can be readily used in mobile communication devices such as a portable telephone and the like by connecting the input terminal 41*a,* antenna terminal 41*b* and output terminal 41*c* to external conductors.

With the above structure, the dielectric resonator element 1*a* and the multilayer circuit element 10 are supported on the printed board 40, so the bottom of the dielectric device is formed by the printed board 40. This enables a stable and assured mounting of the dielectric device onto a mounting circuit board to be attained, without causing an unsound, unstable or unsecured condition of the resonator element 1*a* and/or the circuit element 10.

Figure 9:
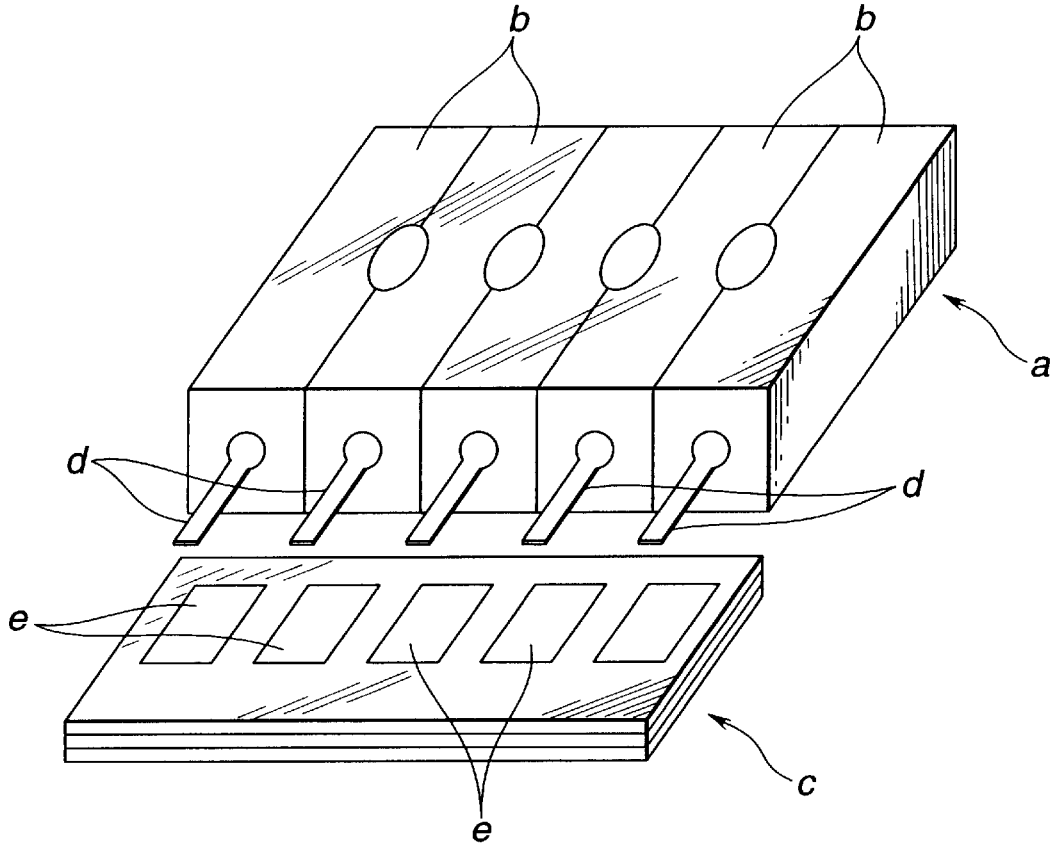
FIG.9 (PRIOR ART)
FIG. 9 is a prior art dielectric device.
Figure 10:
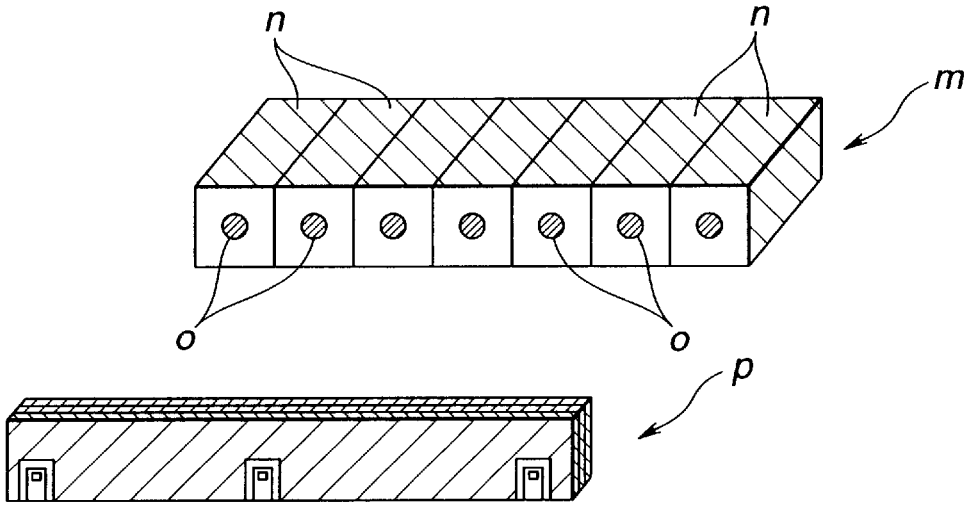
FIG.10 (PRIOR ART)
FIG. 10 is another prior art dielectric device.

In the above structure, the multilayer circuit element 10 is connected to the resonator element 1*a* at one vertical side surface extending along the longitudinal direction thereof when the conductive patterns constituting the various electrodes, alternating with the dielectric layers are laminated vertically, i.e., at one vertical side surface which is constituted by the longer peripheral sides of the dielectric layers 11*a,* 11*b,* 11*c,* 11*d,* 11*e* and not by the upper or lower side surface of the dielectric layer as in the prior art structure in FIG. 10. Thus, the dielectric device of this invention does not encounter such restrictions on the shape or configuration as the prior art devices shown in FIGS. 9 and 10 encounter and can have good design freedom and enables the circuit element 10 to attain an LC coupling circuit having an improved capacitance and inductance. FIG. 9 depicts reference characters a, b, c, d and e. FIG. 10 illustrates n, m, o and p.

Further, the dielectric resonator element 1*a* is constituted by a plurality of coaxial resonators 3A, 3B, 3C and 4A, 4B, 4C which are arranged in parallel to each other on the printed board 40, so there can be attained such an advantage that the resonance characteristics of each of the coaxial resonators 3A, 3B, 3C and 4A, 4B, 4C can be adjusted individually and therefore the dielectric resonator element 1*a* of suitable resonance characteristics can be obtained. In the meantime, in the above described assembling of the dielectric device, the coaxial resonators 3A, 3B, 3C and 4A, 4B, 4C can be joined to form an integral unit prior to its mounting onto the printed board 40 and then attached all at once to the printed board 40 or can be attached to the printed board 40 individually.

Figure 7:
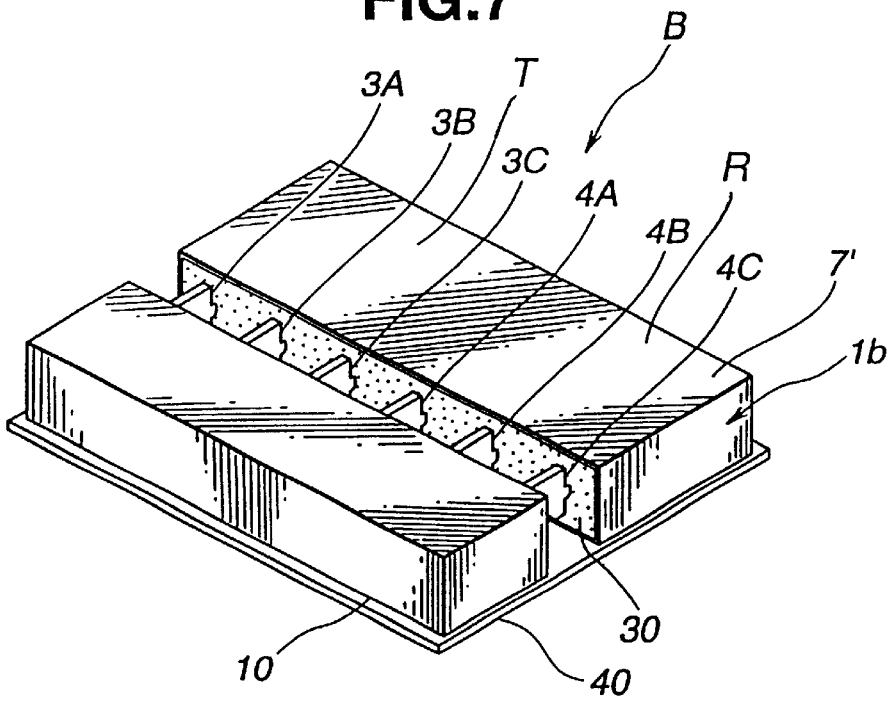
FIG. 7 is a perspective view of a dielectric device according to a second embodiment of the present invention.
Figure 8:
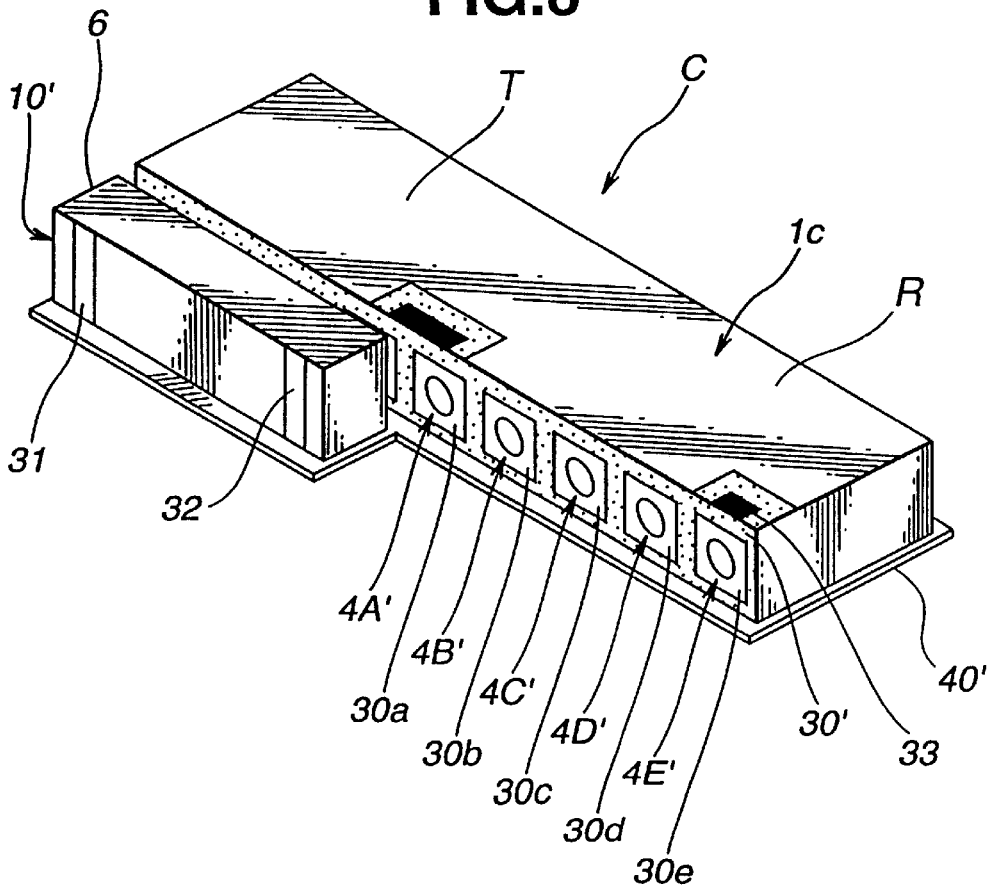
FIG. 8 is a perspective view of a dielectric device according to a third embodiment of the present invention.

FIG. 7 shows a dielectric device B according to a second embodiment of the present invention. The dielectric device B includes a dielectric resonator element 1*b* (refer to FIG. 6 and FIG. 7) made up of a single ceramic block 30 formed with a plurality of through holes whose inner circumferential surfaces are covered by inner conductors. The ceramic block 30 is covered by an outer conductor 7' (refer to FIG. 7) except for the front open end thereof such that the resonators 3A, 3B, 3C for the transmitting section T and the resonators 4A, 4B, 4C for the receiving section R are constituted by using the single ceramic block 30. By this structure, installation of the dielectric resonator element 1*b* onto the printed board 40 can be easier since the resonator element 1*b* is a single piece. Except for the above, this embodiment is substantially similar to the first embodiment and can produce substantially the same effect.

While in the above described first and second embodiments the multilayer circuit element 10 is connected to all of the resonators 3A, 3B, 3C and 4A, 4B, 4C, i.e., both of the transmitting section T and the receiving section R, the circuit element may be connected only to the resonators 3A, 3B, 3C, i.e., the transmitting section T as in a dielectric device C according to a third embodiment shown in FIG. 8.

As shown in FIG. 8, in the dielectric device C, the multilayer circuit element 10' is connected only to the resonators of the transmitting section T of the dielectric resonator element 1*c*. At the receiving section R, the resonator element 1*c* is provided with the resonators 4A', 4B', 4C',4D',4E' by using the single ceramic block 30' formed with a plurality of through holes whose inner circumferential surfaces are covered by inner conductors. At the open end, the resonator element 1*c* is provided with conductive layers 30*a,* 30*b,* 30*c,* 30*d,* 30*e* connected to the inner conductors of the respective resonators 4A', 4B', 4C', 4D', 4E' such that coupling capacitors are provided between adjacent two of the conductive layers 30*a,* 30*b,* 30*c,* 30*d,* 30*e.* In this connection, 31 is a transmitting pad, 32 is an antenna pad, and 33 is a receiving pad. By the above structure, this embodiment can have an equivalent circuit similar to that of FIG. 6 though different from the previous embodiments of FIGS. 1 and 7 in the number of the resonators for the receiving section R.

From the foregoing, it will be understood that the present invention can produce the following effects:

(1) The dielectric resonator element and the multilayer circuit element are electrically connected with the metallic terminal members, so that lead wire, wire bonding or the like can be dispensed with, the resonator element and the circuit element can be neatly arranged, and the dielectric device can be produced with ease.

(2) The dielectric resonator element and the multilayer circuit element are mounted on the printed board. This enables the dielectric device to take a simple rectangular shape as a whole while enabling the dielectric device to have a single flat or flush bottom, so that the dielectric device can be held on the mounting circuit board in a stable state, without causing any unsound, or any unstable condition of the resonator element and/or circuit element. Further, the filter circuits can be small-sized and the dielectric layers can be smaller, so the dielectric device can be smaller as a whole.

(3) The dielectric resonator element and the multilayer circuit element are supported on the printed board and allowed to move vertically relative to each other at the time of mounting onto the circuit board, so they can be fit well on the printed board.

(4) The dielectric layers can be varied in area as desired while being held constant in thickness, so the dielectric device structures shown in FIGS. 9 and 10, thus making it possible to attain good design freedom and therefore an LC coupling circuit having an optimum capacitance and inductance. For this reason, capacitor electrodes and inductors can be formed on the dielectric layers suitably, so the circuit element can have improved characteristics.

(5) The filter circuit is constituted by the dielectric resonator element 1*a,* 1*b* or 1*c* and the multilayer circuit element 10 or 10' only, so the device can attain an increased mechanical strength and an improved impact or shock resistance.

(6) The coupling circuit Y is so structured as to be enclosed in the multilayer circuit element 10 or 10' and is therefore isolated or shut off from the outside atmosphere so is hardly influenced by the humidity, mechanical shock and the like and therefore can be stable in characteristics.

(7) The coupling circuit is constituted by the multilayer circuit element, so one having a desired circuit constant can be attained with ease and therefore good design freedom of a duplexer can be attained.

While the invention has been described above by reference to the certain embodiments, i.e., dielectric duplexers, the invention is not limited to the embodiments described above. Modifications and variations of the embodiments described above will occur to those skilled in the art, in light of the above teachings. The scope of the invention is defined with reference to the following claims.

What is claimed is:

1. A dielectric device comprising:

a dielectric resonator element having a plurality of resonators arranged in parallel with each other, said plurality of resonators having through holes provided with inner conductors, respectively; a multilayer circuit element having conductive patterns constituting a coupling circuit, said conductive patterns being laminated vertically while alternating with dielectric layers; said circuit element being rectangular and elongated along a longitudinal direction and having a pair of first and second opposite vertical side surfaces thereof, and said coupling circuit having first connecting ends disposed at said first vertical side surface and second connecting ends disposed at said second vertical side surface; and a plurality of metallic terminal members electrically connecting between said respective inner conductors of said plurality of resonators and said first connecting ends of said coupling circuit.

2. A dielectric device according to claim 1, wherein said circuit element comprises a plurality of vertical conduction grooves disposed at said first vertical side surface so as to correspond in position to said plurality of resonators, each of said vertical conduction grooves having a respective inner surface provided with a corresponding connecting conductor which constitutes each of said first connecting ends of said coupling circuit, each of said metallic terminal members having a first end thereof fitted in each of said through holes of said plurality of resonators and thereby electrically connected to a corresponding one of said inner conductor and a second end thereof vertically movably fitted in corresponding one of said vertical conduction grooves and thereby electrically connected to each of said first connecting ends of said coupling circuit.

3. A dielectric device according to claim 2, further comprising a printed board mounting thereon said resonator element and said circuit element and having external connecting terminals electrically connected to said second connecting ends of said circuit element.

4. A dielectric device according to claim 3, wherein said printed board has an upper surface including an upper surface section on which said circuit element is mounted and a lower surface including a lower surface section opposite to said upper surface section, said printed board having at said lower surface section said external connecting terminals and at said upper surface section interconnection terminals electrically connecting between said respective second connecting ends of said coupling circuit and said external connecting terminals.

5. A dielectric device comprising:

a dielectric resonator element having a plurality of resonators arranged in parallel with each other, said resonators having through holes provided with inner conductors, respectively;

a multilayer circuit element having conductive patterns constituting a coupling circuit, said conductive patterns being laminated vertically while alternating with dielectric layers;

said circuit element being rectangular and having a pair of first and second opposite vertical side surfaces extending along the longitudinal direction thereof, and said coupling circuit having first connecting ends disposed at said first vertical side surface and second connecting ends disposed at said second vertical side surface;

a plurality of metallic terminal members electrically connecting between said inner conductors of said resonators and said first connecting ends of said coupling circuit; and a printed board mounting thereon said resonator element and said circuit element and having external connecting terminals electrically connected to said second connecting ends of said coupling circuit.

6. A dielectric device according to claim 5, wherein said plurality of resonators are coaxial resonators and comprise independent ceramic blocks having said through holes and said inner conductors, respectively.

7. A dielectric device according to claim 5, wherein said dielectric resonator element comprises a single ceramic block formed with said through holes of said resonators.

8. A dielectric device according to claim 5, wherein said resonators include a first group for constituting a transmitting section of a duplexer and a second group for constituting a receiving section of the duplexer, said coupling circuit of said circuit element being connected to said resonators for said transmitting section and said receiving section in a predetermined manner, to constitute the dielectric duplexer.

9. A dielectric device according to claim 5, wherein said coupling circuit of said circuit element comprises a low-pass filter circuit section connected to said resonators of said first group and a band pass filter circuit section connected to said resonators of said second group, said resonator element further comprising conductive layers electrically connected to said inner conductors of said resonators of said second group, said conductive layers being capacity-coupled to constitute said band pass filter circuit section of said coupling circuit.

10. A dielectric device according to claim 5, wherein said circuit element comprises a plurality of vertical conduction grooves disposed at said first vertical side surface, each of said conduction grooves having a respective inner surface provided with a connecting conductor which constitutes each of said first connecting ends of said coupling circuit, each of said metallic terminal members having a first end thereof fitted in each of said through holes of said plurality of resonators and thereby electrically connected to each of said inner conductors and a second end thereof fitted in each of said vertical conduction grooves and thereby electrically connected to each of said first connecting ends of said coupling circuit.

11. A dielectric device according to claim 10, wherein said conduction grooves have open upper ends, respectively.

12. A dielectric device according to claim 5, wherein said printed board has an upper surface including an upper surface section on which said circuit element is mounted and a lower surface including a lower surface section opposite to said upper surface section, said printed board having at said lower surface section said external connecting terminals and at said upper surface section interconnection terminals electrically connecting between said respective second connecting ends of said coupling circuit and said external connecting terminals.

* * * * *